US010694833B2

(12) United States Patent
Tiblas

(10) Patent No.: US 10,694,833 B2
(45) Date of Patent: Jun. 30, 2020

(54) RUCKSACK WITH CONTINUOUS BACK LENGTH ADJUSTMENT

(71) Applicant: Deuter Sport GmbH, Gersthofen (DE)

(72) Inventor: Miguel Tiblas, Augsburg (DE)

(73) Assignee: Deuter Sport GmbH, Gersthofen (DE)

( * ) Notice: Subject to any disclaimer, the term of this patent is extended or adjusted under 35 U.S.C. 154(b) by 0 days.

(21) Appl. No.: 15/916,111

(22) Filed: Mar. 8, 2018

(65) Prior Publication Data

US 2018/0255910 A1 Sep. 13, 2018

(30) Foreign Application Priority Data

Mar. 8, 2017 (DE) ..... 20 2017 101 329 U

(51) Int. Cl.
*A45F 3/04* (2006.01)

(52) U.S. Cl.
CPC ..... *A45F 3/047* (2013.01); *A45F 3/04* (2013.01); *A45F 2003/045* (2013.01)

(58) Field of Classification Search
CPC ..... A45F 3/047; A45F 3/04; A45F 2003/045
USPC ..... 224/631
See application file for complete search history.

(56) References Cited

U.S. PATENT DOCUMENTS 5,284,279 A * 2/1994 Sason ..... A45F 3/047 224/632
5,432,984 A * 7/1995 Petzl ..... A44B 11/18 24/197
5,449,102 A * 9/1995 Sason ..... A45F 3/047 224/632
5,904,282 A * 5/1999 Gleason ..... A45F 3/08 224/263
5,971,244 A * 10/1999 Jaeger ..... A45F 3/08 224/632
6,179,188 B1 * 1/2001 Gleason ..... A45F 3/047 224/262
7,152,771 B2 * 12/2006 Le Gal ..... A45F 3/047 224/631
7,232,048 B2 * 6/2007 Le Gal ..... A45F 3/04 224/201
7,946,460 B2 * 5/2011 Yip ..... A45F 3/047 224/627

(Continued)

FOREIGN PATENT DOCUMENTS

CH 678796 A5 11/1991
EP 0122764 A2 10/1984

(Continued)

*Primary Examiner* — Nathan J Newhouse
*Assistant Examiner* — Lester L Vanterpool
(74) *Attorney, Agent, or Firm* — Bradley Arant Boult Cummings; Timothy L. Capria

(57) ABSTRACT

A rucksack is provided with a first shoulder strap and a second shoulder strap, whereby respective end sections of the shoulder straps are connected with each other by means of a middle piece. The middle piece is continuously slidable along at least one guide element in a vertical direction of the rucksack. The middle piece is attached to a strap with a first free end and a second free end, whereby the free ends are coupled with each other in a way that permits a transfer of a tensile force. The strap is redirected at a first redirecting element and a second redirecting element, which are located opposite each other in the vertical direction of the rucksack.

20 Claims, 5 Drawing Sheets

(56) References Cited

U.S. PATENT DOCUMENTS

| | | | | |
|---|---|---|---|---|
| 8,544,709 | B2 * | 10/2013 | Paik | A45F 3/04 224/632 |
| 9,826,816 | B1 | 11/2017 | Chang | |
| 2010/0301085 | A1 * | 12/2010 | Smith | A45F 3/04 224/637 |
| 2011/0284609 | A1 * | 11/2011 | McGill | A45F 3/047 224/633 |
| 2016/0037895 | A1 * | 2/2016 | Humphreys | A45F 3/08 224/633 |

FOREIGN PATENT DOCUMENTS

| | | | |
|---|---|---|---|
| EP | 821895 | A1 | 2/1998 |
| EP | 1602299 | A1 | 12/2005 |
| JP | H10117845 | A | 5/1998 |
| JP | 3468819 | B | 11/2003 |
| JP | 2005532844 | A | 11/2005 |
| JP | 2012020111 | A | 2/2012 |
| KR | 101518174 | B1 | 5/2015 |
| WO | 2003/077704 | A1 | 9/2003 |

* cited by examiner

RUCKSACK WITH CONTINUOUS BACK LENGTH ADJUSTMENT

This application is a nonprovisional patent application filed by applicant Deuter Sport GmbH for the invention by Miguel Tiblas, a citizen of Germany, residing in Augsburg, Germany, entitled, "Rucksack with Continuous Back Length Adjustment." This application claims priority to German Utility Model 202017101329.4, filed on Mar. 8, 2017.

TECHNICAL FIELD

The invention relates to a rucksack with a first shoulder strap and a second shoulder strap, wherein the respective end sections of the shoulder straps are connected with each other by means of a middle piece. The middle piece is continuously movable along at least one guide element in a vertical direction of the rucksack.

BACKGROUND

These types of backpacks with a continuous back length adjustment are known, for example, from EP 1 602 299 A1 or from EP 0 122 764 A2.

In the EP 1 602 299 A1, a yoke plate, attached to the two shoulder straps, slides along two rods, when the shoulder straps' height is adjusted. The yoke plate can be pulled down by means of a strap. The strap is guided through a passageway, which is formed in a back plate of the rucksack. A toothed strip is arranged at one end of the strap, which can be gripped by a user of the rucksack. This toothed strip can be arrested by means of a locking mechanism.

One disadvantage to be considered here is that the yoke plate is, in fact, prevented from moving upward in this type of back length adjustment. It is, however, possible to move the yoke plate downward, however, when the toothed strip is arrested in the locking mechanism. Furthermore, this type of adjustment mechanism is relatively stiff, because the strap is threaded through the passage in the back plate and must therefore overcome significant friction forces.

In the rucksack described in EP 0 122 764 A2, scapula pads of the shoulder straps on the rucksack are arranged along a transverse plate, which is movable along two vertical frame members. Runners are arranged on the frame members to which straps are mounted to move the transverse plate. The runners are mounted on the frame members so tightly that they can only be moved when force is applied.

In this rucksack as well, the mechanism for the back length adjustment must be stiff.

What is needed then is a rucksack of the type described above in which the continuous back length adjustment can be carried out in a particularly easy and smooth manner.

BRIEF SUMMARY

By redirecting the strap at the first redirecting element and at the second redirecting element, a particularly good ease of operation is achieved during the continuous movement of the middle piece in the vertical direction of the rucksack, because the friction forces that must be overcome at these two redirecting elements, or, respectively, redirecting points are very low. This also makes the continuous back length adjustment of the rucksack particularly easy. Furthermore, it is not necessary to unbuckle the respective clasps or the like at the two ends of the strap to change the back length of the rucksack. Rather, even during the continuous adjustment of the back length of the rucksack, the end sections of the strap remain coupled with each other in the manner that permits the transfer of the tensile force. The term 'back length of the rucksack' is to be understood here to refer to a distance between a theoretical line connecting the end sections of the shoulder straps and a lower end of a hip belt of the rucksack or, respectively, a floor of the rucksack.

Preferably, the strap comprises a first and a second layer, which are movable through the redirecting of the strap around the redirecting elements in opposite directions. An arresting device is provided here, which serves a reversible and/or destruction-free fastening of the first layer relative to the second layer. It is particularly easy to prevent an upward movement of the middle piece in the vertical direction of the rucksack by means of the arresting device. It is possible as well, however, to arrange for both the upward movement of the middle piece in the vertical direction of the rucksack and a downward movement of the middle piece in the vertical direction of the rucksack or even just the downward movement of the middle piece being prevented by means of the arresting device. Accordingly, the provision of the arresting device permits the fastening of the middle piece in a desired position.

This way, it can be ensured that the desired position of the middle piece and therefore a desired back length is maintained even if forces are exerted on, or forces impact, components of the rucksack, the shoulder straps and/or the middle piece. The provision of the arresting device increased the functional capabilities of the rucksack with the continuous back length adjustment.

An arresting device may, for example, provide for a Velcro fastener, which may be formed in particular on the surfaces of the two layers that face each other or between one of the layers and a back part of the rucksack. In addition, or alternatively, a clip or the like may be provided as an arresting device, which presses the two layers against each other.

The arresting device is particularly easy to operate, however, if the arresting device comprises a lever, which is movable from a locked position, in which the two layers are fastened relative to each other, to a release position. In the release position, the two layers are movable in the opposite directions.

It is particularly easy for the user of the rucksack, or respectively, the wearer of the rucksack to move the lever from the lock position to the release position, especially with one hand. Then, it is possible to grab the middle piece with the other hand and to move it along the at least one guide element in the vertical direction of the rucksack upward or downward to achieve the desired back length.

The lever may be arranged on a buckle element on which one of the redirecting elements is formed. This way, the level is particularly unnoticeable, and a high function integration is achieved with the formation of the back length adjustment.

It was furthermore found preferable that the lever lies against a cover in the lock position whereby a partial section of the buckle element is pressed against a back part of the rucksack. This way, a support is provided, which causes the lever to move in a very easy and fail-safe manner. To detach the arresting device, the lever can then be moved particularly easily from the lock position to the release position, because the cover prevents the entire buckle element from moving in the lever's operating direction.

The cover may be formed in the shape of a plate to ensure a particularly good manner in which the partial section of the buckle element is pushed against the back part of the rucksack. A plate made from a plastic such as polyethylene may, for example, be used as the cover. The plate may comprise wings, which lie in particular against the back part of the rucksack and which are connected with the back part of the rucksack. They may be arranged on both sides of the strap. Such a cover makes it possible to fasten the buckle element particularly well in one location, which then makes it possible to move the lever from the lock position to the release position.

The buckle element can be fastened directly on the back part of the rucksack, for example by sewing webbing attached to the buckle element to the back part. It may, however, also be desirable to replace the buckle element with the lever, for example in the event of damage or a functional impairment of the lever and/or the buckle element.

It has also been found to be preferable for the buckle element to be held to a first belt buckle part by means of webbing, which is detachably coupled with a second belt buckle part. Here, the second belt buckle part is fastened to the back part of the rucksack.

The lever may have a plurality of teeth to keep the first position. The teeth may, in the lock position, hook in the first position. Thereby, the first position is also fastened reversibly and/or destruction-free detachably relative to the second position. By providing such a lever, a particularly easy and fail-safe arresting device is provided.

The teeth may, in particular, be formed such that the teeth do not allow an upward movement of the middle piece in the vertical direction of the rucksack when the arresting device is in the lock position. This prevents any load forces affecting the shoulder straps in the upward direction, which may occur when the loaded rucksack is carried or put on, from causing an undesirable upward movement of the middle piece. However, an orientation and/or bending of the teeth in the downward directly may cause a downward movement of the middle piece and cause difficulty due to the friction on the teeth when the arresting device is in the lock position, but still allow it. This simplifies the ease of operation of the rucksack during the back length adjustment.

It was furthermore found to be preferable when the lever is movable from the lock position to the release position against the force of a spring element. In that case, the lever automatically snaps back into the lock position after it is released, and the two layers are fastened or, respectively, arrested relative to each other directly after the lever is released.

Preferably, at least one mesh element fastened to a middle piece forms a tunnel through which the first layer is guided. Here, the first layer is connected to at least one mesh element. This way, the middle piece is attached to the strip in a particularly robust and durable manner.

A particularly good ease of use when adjusting the back length of the rucksack is achieved, when the second layer is arranged outside the tunnel or tunnels, respectively, because this significantly reduced the friction forces during the continuous adjustment of the back length of the rucksack.

The two free ends of the strap can be connected to each other by means of a buckle element. The first free end can, for example, be fastened to the buckle element by sewing, while the second free end is threaded into the buckle element. Such a buckle element may, for example, be a tri-glide buckle, i.e. a buckle comprising a frame and in particular a centered bar arranged in the frame. This is a particularly easy way in which the coupling of the two ends can be ensured in a manner that allows the transfer of the tensile force.

Furthermore, the two free ends of the strap may be formed as loops, which are connected for example by means of a belt buckle. The coupling of the free ends of the straps that allows the transfer of the tensile force can be particularly easily achieved by joining a first belt buckle part and a second belt buckle part of the belt buckle.

It is also possible to thread the loops into the frame-like hook, which, however, is not completely closed. Rather, the, in particular substantially rectangular, frame of the hook comprises an opening through which the loops can be hung on the hook. Such a hook with an opening, in particular if it is configured as a square ring, allows for a simple and destruction-free detachable coupling of the free ends of the straps with each other for transferring the tensile force.

The loops may furthermore be connected with each other by means of a U-shaped hook, whereby the respective sides of the hook pass through the loops. This type of configuration of a coupling element used to couple the two free ends of the strap in a manner that allows for the transfer of the tensile force provides a particularly flat coupling element for the free ends of the strap. Furthermore, the strap is particularly easy to replace this way, if this is desired or necessary.

Preferably, to ensure that the sides of the hook do not come off the loops, they are secured by means of a fastening element. A ring, for example, in particular a metal ring, can be provided at one end of the one side, and the end of the second side can be inserted in the ring. In particular a locking pin provided on the second side can secure the fastening element or the ring, respectively. This type of fastening element can prevent uncoupling, while the sides move away from each other during tensile stress on the sides of the hook. This way, the length of the strap can be kept particularly constant. This, in turn, causes the desired back length, once it has been set, to be maintained permanently.

Preferably, one of the redirecting elements is formed as a ring, which is arranged in an upper region of a back part of the rucksack. On the one hand, this makes it easy to adjust the back length. On the other hand, this makes the redirecting element particularly robust. Furthermore, this particular arrangement of the redirecting elements achieves a particularly large adjustment travel when adjusting the back length of the rucksack.

Preferably, the ring is hidden by a cover. Then, the ring bothers the user of the rucksack even less. A tongue or flap may, for example, be formed on a head cavity of the back part, in particular from mesh, behind which the ring is arranged in a hidden manner. This way, the ring is protected against dirt as well. This is helpful for the permanent ease of use when adjusting the back length of the rucksack.

The ring may be formed from a particular metal and/or from a particular plastic. In particular n smaller, or lighter rucksacks, for example rucksacks with a volume of less than 30 liters, it is advantageous due to the weight of the rucksack, to use plastic as the ring material. For larger, or heavy rucksacks, respectively, for example rucksacks with a volume of more than 50 liters, a metal ring is preferable for stability reasons.

If the ring is formed in a substantially rectangular manner, then the redirecting element creates only a small amount of friction. In addition, the ring then requires very little space in the vertical direction of the rucksack.

Preferably, the middle piece is movable along two guide elements in the vertical direction of the rucksack, which comprise, in a first region, in which the middle piece is continuously movable, a first constant distance from each other. The parallelism of the guide elements in the first region ensures that the middle piece is particularly easy to move in the vertical direction.

The guide elements in a second region may, however, have a second distance from each other, which is shorter than the first distance. The two guide elements may, in particular in the region of a hip belt of the rucksack, have the second distance from each other. This makes it possible to achieve a better adjustability to different hip belt systems. In this second region, the distance of the guide elements does not have to be constant, either, because the movement of the middle piece during the back length adjustment only takes place in the first region.

Especially when the rucksack is smaller or lighter, separate carrying elements, for example in the form of rails, may be provided in addition to parallel arranged guide elements, which serve the movability of the middle piece in the vertical direction.

The features and feature combinations mentioned above in the description as well as the features and feature combinations mentioned below in the description of the figures and/or in the figures alone are not only usable in the combination indicated, but in other combinations or by themselves as well without leaving the scope of the invention. The invention therefore comprises and discloses therefore embodiments that are not explicitly shown or explained in the figures, but that are indicated and that can be generated from the explained embodiments by means of separate feature combinations.

Further advantages, features, and details of the invention can be gathered from the claims, the description of preferred embodiments below, as well as the drawings.

DETAILED DESCRIPTION

Figure 1:
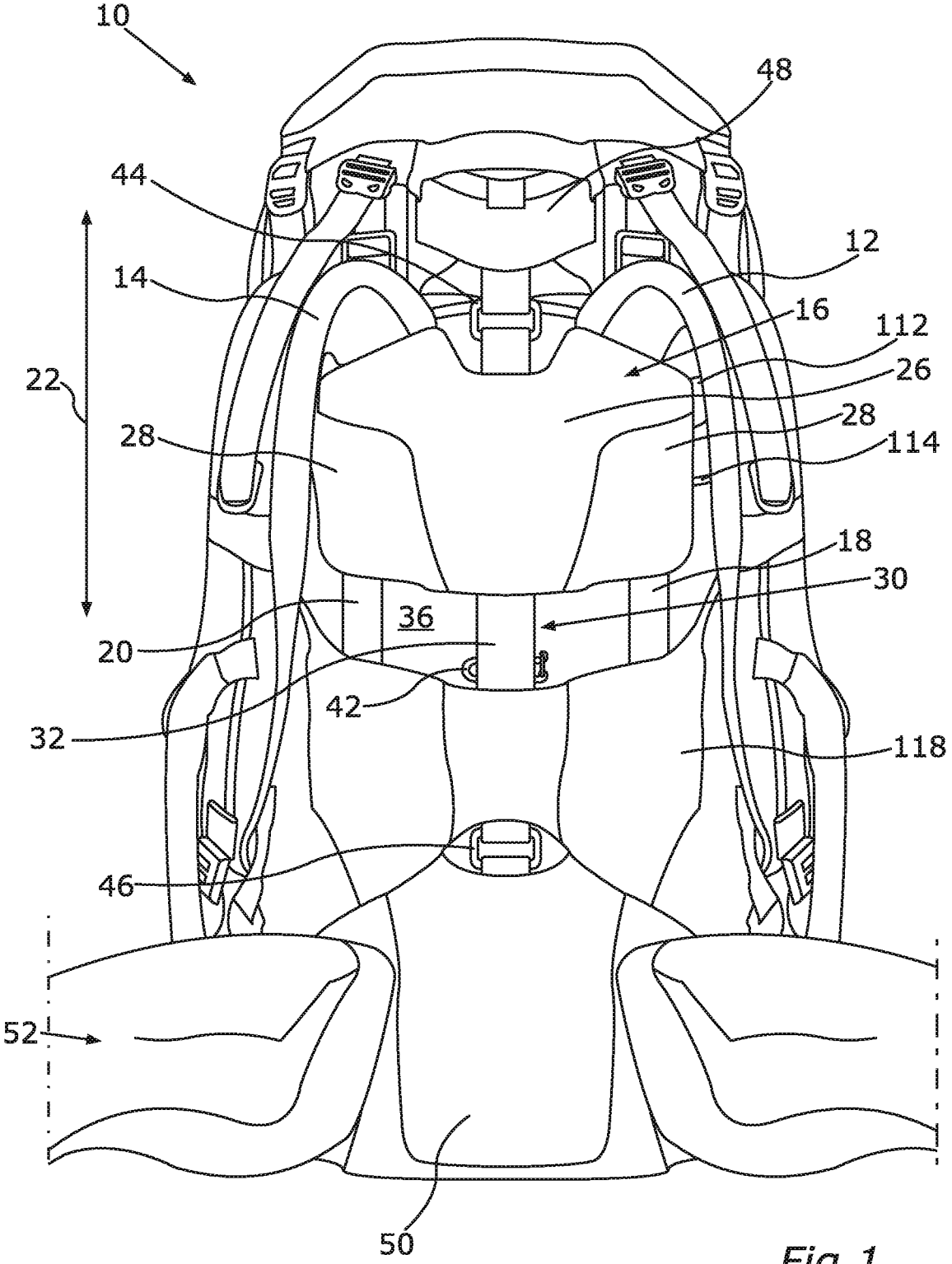
FIG. 1 A view of the back of a rucksack with continuous back length adjustment, in which a strap with coupled ends is attached to a middle piece, to which two shoulder straps of the rucksack are attached.

FIG. 1 shows a rucksack 10 comprising a first shoulder strap 12 and a second shoulder strap 14. The end sections of the shoulder straps 12, 14 are attached to a middle piece 16. The middle piece 16 is continuously movable along two guide rails 18, 20 that serve as guide elements in a vertical direction 22 of the rucksack 10, i.e. upward or downward. The vertical direction 22 is therefore illustrated in FIG. 1 by a double arrow. The guide rails 18, 20 can be formed in particular from an aluminum alloy.

The middle piece 16 is also referred to as the central component of the shoulder straps and ensures at the same time that the end sections of the shoulder straps 12, 14 are connected with each other. The middle piece 16 comprises a plate-type base 24 (cf. FIG. 6), which can be provided, for example, by at least one substantially rectangular plate from a plastic such as polyethylene. On this plate-type base 24 are the pads 26, 28 shown in FIG. 1, which lie against the back of a user of the rucksack 10 in the region of the shoulder blades (or respectively in the region of the upper back), when the user wears the rucksack 10.

Figure 2:
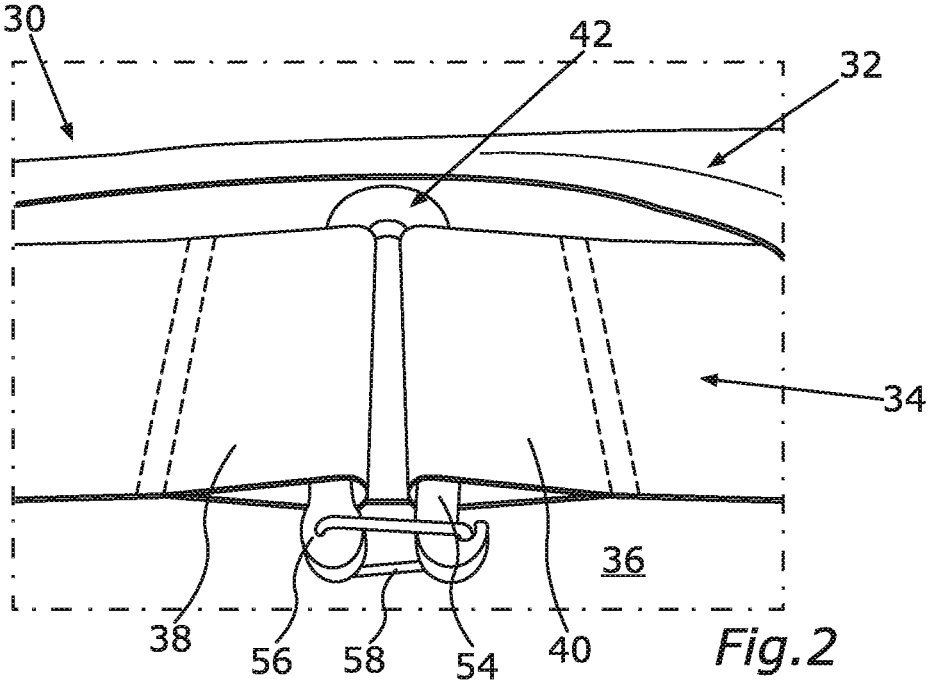
FIG. 2 An option of coupling the two free ends of the strap, which comprises two layers that are movable relative to each other.

The middle piece 16 is, in this case, attached to a strap 30, of which the first layer 32 that faces the back of the user is shown in FIG. 1. The strap 30, however, has a second layer 34 as well, which is shown in FIG. 2 and which is covered in FIG. 1 by the first layer 32. This second layer 34 of the strap 30 is located between the first layer 32 and a back part 36 of the rucksack 10. In the embodiment of the rucksack 10 shown here, the free ends 38, 40 of the strap 30 are configured as loops (cf. FIG. 2). The free ends 38, 40 can be coupled with each other, for example by means of a U-shaped hook 42 in a manner that permits the transfer of a tensile force. This coupling of the two free ends 38, 40 of the strap 30 with each other provides a closed, or respectively revolving strap 30 to which the middle piece 16 is attached.

The strap 30 is redirected on a first redirecting element in the form of a ring 44 and on a second redirecting element, which, in the embodiment of the rucksack 10 shown in FIG. 1, is formed as a ring as well. The two rings 44, 46 face each other when looking at them from the vertical direction 22 of the rucksack 10. Here, the top ring 44 is arranged, for example, in the upper region of the back part 36, i.e. below a head cavity 48 of the rucksack 10. The bottom ring 46, or respectively the bottom redirection element is, however, in the embodiment of the rucksack 10 shown in FIG. 1, arranged above a central lumbar pad 50 in the region of a hip belt 52 of the rucksack 10. The strap 30 formed as a closed loop by the coupling of the free ends 38, 40 with each other, runs through these redirection elements in the form of the rings 44, 46, when the middle piece 16 is adjusted along the guide rails 18, 20. This redirecting process can be carried out with minimal friction, so that the continuous adjustment of the back length of the rucksack 10 can be carried out with great ease of use.

FIG. 2 shows that, when using the hook 42 to couple the free ends 38, 40 of the strap 30, forced as loops, with each other, the respective sides 54, 56 of the U-shaped hook 42 can enter through the loops. There, where the sides 54, 56 exit from the loops, a fastening element is provided in the form of a fastening ring 58 from metal, which holds the ends of the two sides 54, 56 together. The fastening ring 58, may, for example, be guided through an opening, which is formed in the side 56, and be held on the other side 54 in a take-up device.

Figure 3:
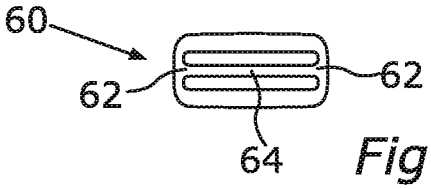
FIG. 3 An alternative buckle element to couple the two free ends of the strap with each other.

It is also possible, however, to couple the two free ends 38, 40 of the strap 30 by means of a buckle 60, which is shown in FIG. 3, and which permits the transfer of the tensile force. Such a buckle element can be formed in particular in the manner of a frame, in which side portions 62 of the frame can be coupled with each other through a bar 64. The free end 38, can, for example, be fastened to the buckle 60, which is formed here as a three-bar buckle 60, in particular by means of sewing, and the free end 40 can be threaded into the buckle 60. The two free ends 38, 40 can also, however, be fastened to the buckle 60 or threaded into the buckle 60. It is furthermore feasible to couple the free ends 38, 40 of the strap 30 by means of a belt buckle or key lock in a destruction-free and detachable manner. A ring may also be used as a coupling element to transfer the tensile force, said ring (formed preferably in a rectangular shape) having an opening to hang the free ends 38, 40 of the strap 30 formed as closed loops. The ring, in particular a rectangular ring, or, respectively, bars forming frames may be formed in a rectangular, in particular square, shape in the cross section.

Furthermore, it may be provided that the two free ends 38, 40 of the strap 30 are coupled with each other by means of a Velcro fastener. A coupling point formed by the Velcro fastener, where the two free ends 38, 40 of the strap 30 are connected with each other in a manner that permits the transfer of the tensile force, or respectively a coupling element, for example in the form of the hook 42 or the buckle 60, therefore move upward or downward when the back length of the rucksack 10 is continuously adjusted in the vertical direction 22 of the rucksack 10.

Figure 4:
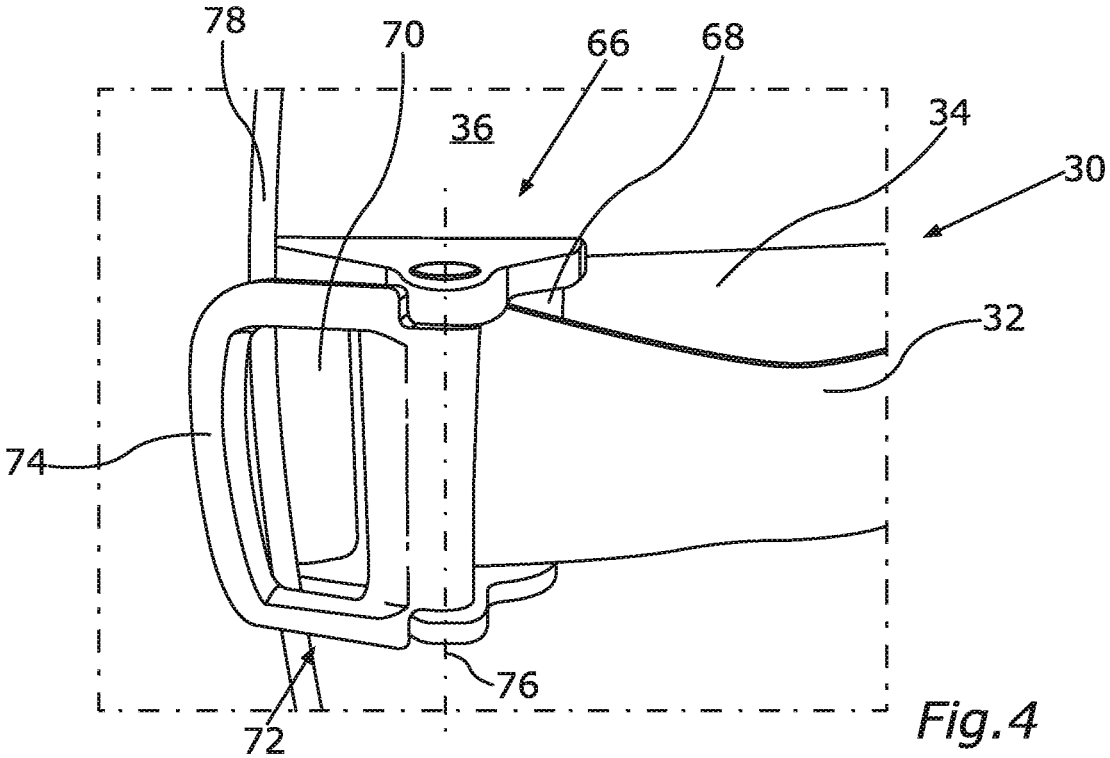
FIG. 4 Another buckle, which is formed as the bottom redirecting element for the strap, whereby the buckle comprises an arresting device with a lever.

In particular the redirecting element that, when viewed from the vertical direction 22 of the rucksack 10, is the bottom element can be formed as a buckle element 66, which is shown as an example in FIG. 4. The buckle element 66 comprises, for example, a bar 68, around which the strap 30 is placed, or, respectively, on which the strap 30 is redirected and thus forms the two players 32, 34. Another bar of the buckle element 66 is fastened to the back part 36 of the rucksack 10 by means of webbing 70.

In the embodiment of the redirecting element shown in FIG. 4, the buckle element 66 furthermore comprises an arresting device 72, which comprises a lever 74. The lever 74 is rotatable around an axis of rotation 76 and comprises teeth at the side facing the first layer 32. In FIG. 4, the lever 74 is shown in its lock position, in which the teeth are hooked into the first layer 32. This prevents the strap 30 from running freely around the redirecting elements.

If, however, the lever 74 is moved away from the back part 36, i.e. moved to its release position, the teeth no longer hook into the first layer 32 and the strap 30 can freely run around the redirecting elements, for example in the form of the bar 68 and the ring 44 (cf. FIG. 1). The lever 74 of the arresting device 72 can be held in the lock position in particular by means of a spring element.

Figure 5:
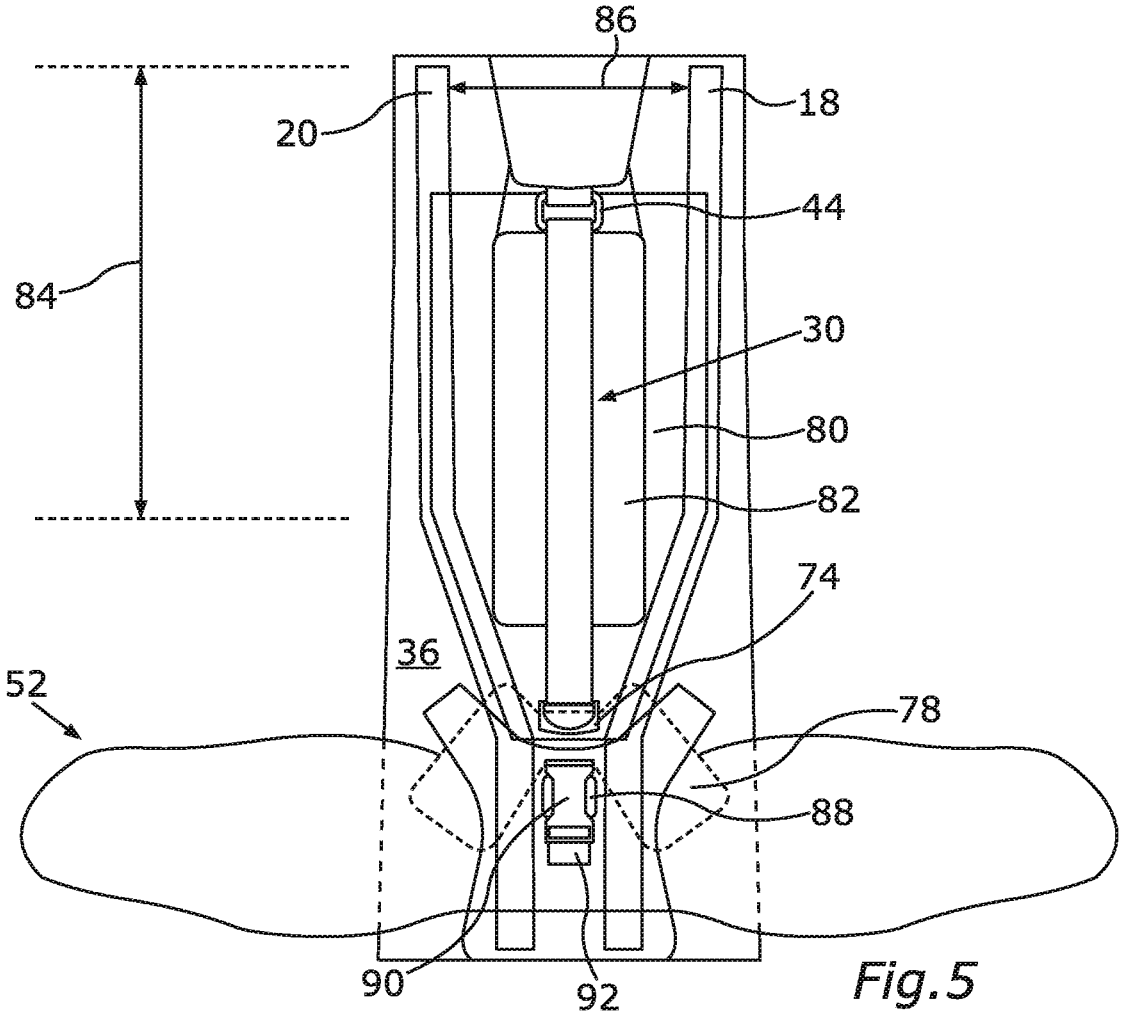
FIG. 5 Components of a back part of the rucksack, whereby the course of guide rails is shown along which the middle piece can be moved, FIG. 6 The attachment of a first layer of the strap to the middle piece, FIG. 7 A flap with which a second redirecting element for the strap is covered, whereby the second redirecting element is formed as a rectangular ring, FIG. 8 Loops or tunnels, respectively, which accommodate the guide rails, and FIG. 9 A scale provided on the back part of the rucksack to indicate the back length as well as a pointer element attached to the middle piece.

In particular when viewed together with FIG. 5, it becomes clear that the lever 74 lies against a plate-type cover 78 in its lock position, through which a portion of the buckle element 66 is pressed against the back part 36 of the rucksack 10. The plate-like cover 78, which, in this case, has the form of a butterfly and therefore has wings arranged on both sides of the strap 30, ensures here that only the lever 74 is moved away from the back part 36 when the lever 74 is shifted to the release position.

FIG. 5 shows as well that the back part 36 of the rucksack 10 may be reinforced by additional plates 80, 82. The additional plates 80, 82 are provided in particular in a region of the back part 36 in which the middle piece 16 can be adjusted in the vertical direction 22. According to FIG. 5, the two guide rails 18, 20 are preferably arranged parallel in a first region 84, in which the middle piece 16 is moved during the continuous back length adjustment. The guide rails 18, 20 therefore have a constant distance 86 from each other in the first region 84. In contrast, the guide rails 18, 20 are less far apart from each other in a second region, i.e. in this case in the region of the hip belt 52. Accordingly, the guide rails 18, 20 show a curve on the level of the back part 36. Furthermore, the guide rails 18, 20 are curved preferably vertical to the level of the back part 36. Thus, the guide rails 18, 20 are arranged closer to the back of the user of the rucksack 10 in the region of the hip belt 52 than in the upper region 84.

FIG. 5 furthermore shows that the buckle element 66 (cf. FIG. 4) of which FIG. 5 only shows the lever 74, may be fastened to a first belt buckle part 88 by means of the webbing, which is coupled detachably with a second belt buckle part 90. The second belt buckle part 90 is attached once again here to the back part 36 of the rucksack by means of webbing 92. In this embodiment, it is particularly easy to replace the buckle element 66.

Figure 6:
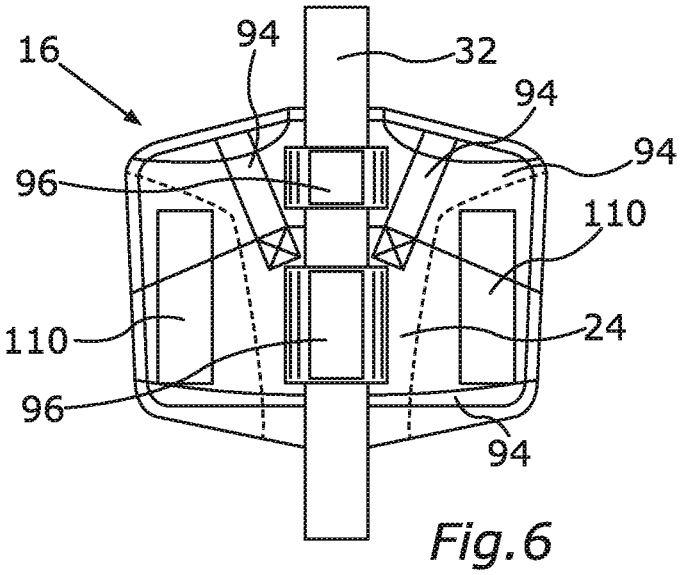

FIG. 6 shows that other, pocket-shaped, or respectively strip-shaped elements 94 may be provided in the region of the plate-type base 24 of the middle piece 16. These types of elements 94 may be provided to connect the shoulder straps 12, 14 to the middle piece 16 or respectively to connect the shoulder straps 12, 14 to the middle piece 16. Furthermore, such elements 94 may form a pocket for the plate-like base 24. The middle piece 16 may furthermore comprise tunnels 110 for the rails 18, 20 formed from mesh elements or the like. Furthermore, two mesh elements 96 attached to the middle piece 16 form the respective tunnels through which the first layer of the strap 30 is guided. In the region of the mesh elements 96, the first layer 32 of the strap 30 is sewn to the middle piece 16 or fastened to it in another suitable manner. The second layer 34 of the strap 30 may also be guided through the tunnels that are formed by the mesh elements 96. Preferably, however, the second layer 34 is located outside of the tunnel formed by the mesh elements 96, because this way, the two layers 32, 34 can be in opposing directions with minimal friction, when the middle piece 16 is moved along the guide rails 18, 20 in the vertical direction 22 of the rucksack 10.

Figure 7:
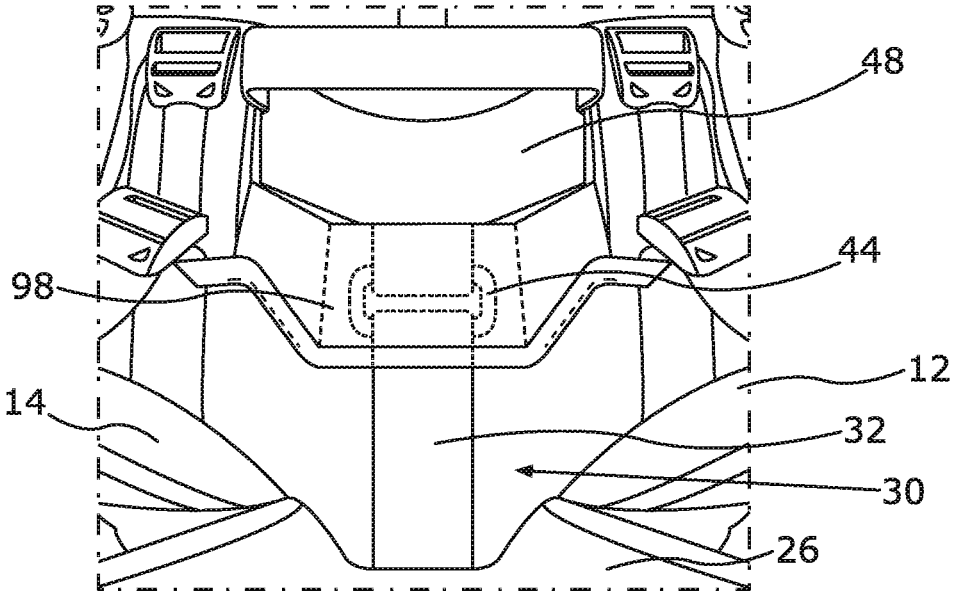

FIG. 7 shows that preferably the ring 44, which serves as the upper redirecting element and which has a substantially rectangular form here, can be hidden by a cover in the form of a flap 98 or the like. In that case, the ring 44 is well protected and contact between the ring 44 with the neck or head of the user of the rucksack 10 is avoided.

Figure 8:
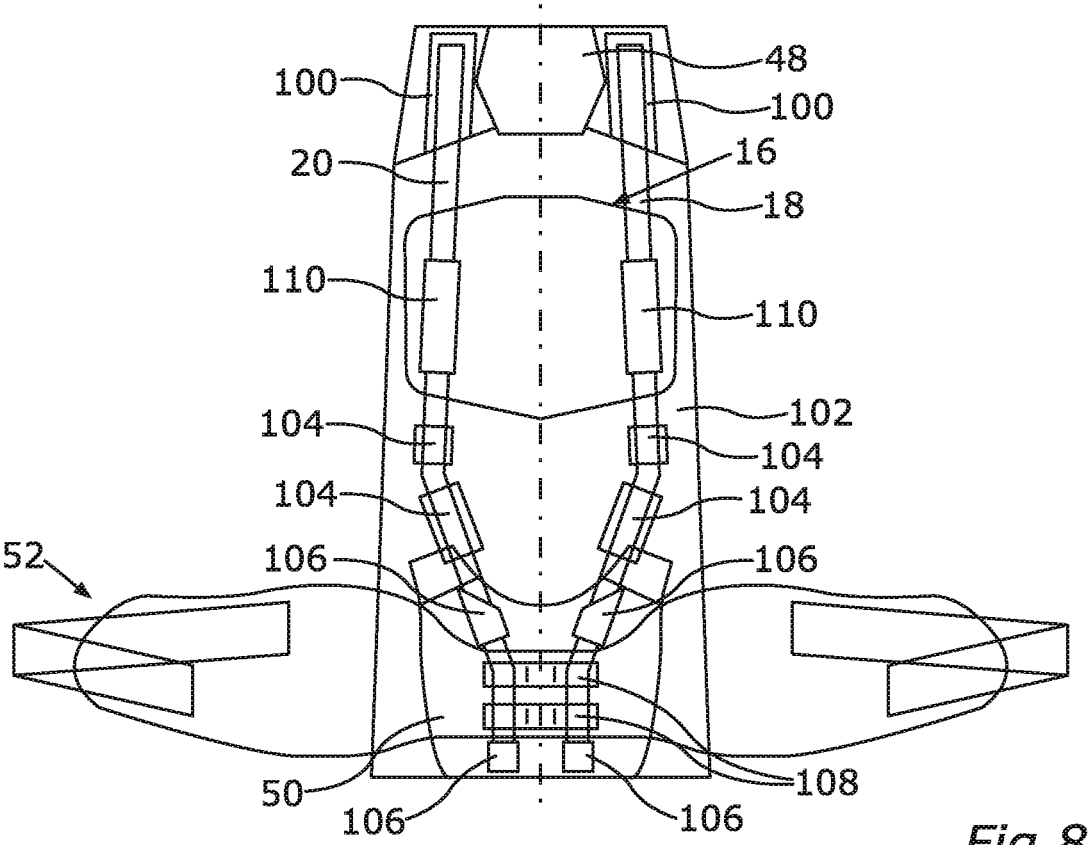

FIG. 8 shows that pockets 100 may be provided in the region of the head cavity 48, which may be directly connected with a back plate 102 of the back part 36 of the rucksack 10 and into which the end sections of the guide rails 18, 20 are inserted. Furthermore, the guide rails 18, 20 can be guided through further feedthroughs or tunnels 104 to fasten their position on the back plate 102, which may also be directly connected to the back plate 102. Additional tunnels 106 or pockets may be provided in the area of the lumbar pads 50. The other end sections of the guide rails 18, 20, may, in particular, be inserted into these types of tunnels 106 or pockets, which are provided in the area of the lumbar pads. In particular where the guide rails 18, 20 pass in the lumbar region, additional reinforcements, in particular in the form of plastic plates and the like, may be provided. Furthermore, reinforcing plates may be provided where the ring 44 is attached, in order to provide a particularly good mounting for the ring 44.

Figure 9:
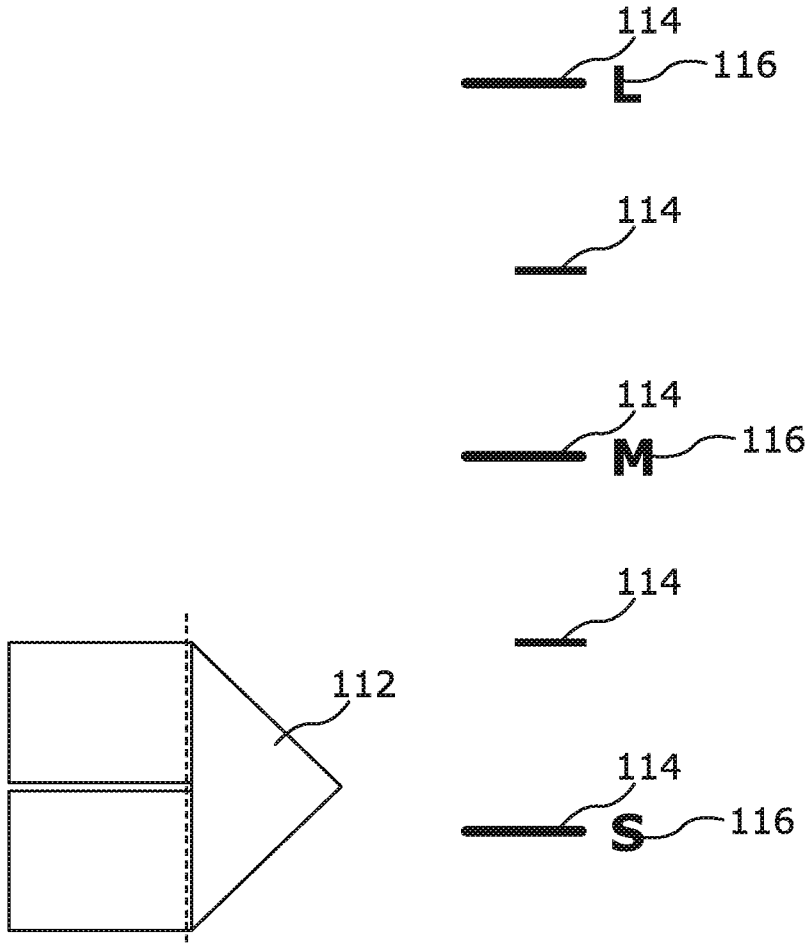

According to FIG. 1, an arrow point 112 is preferably arranged on one side of the middle piece 16, which is schematically shown in FIG. 9. Furthermore, tick marks 114 and/or symbols 116 may be provided on the back part 36 of the rucksack 10, which indicate the length for which the rucksack 10 was adjusted. The symbols 116 may be formed as the letters L, M, and S, for example, to indicate the back length.

The back length adjustment of the rucksack 10 may be provided in particular in a region which is delimited here by the tick marks 114, which are assigned to the symbols 116 L and S. This adjustment range between the tick marks 114 on the symbols 116 in the form of the letters L and S can have a length between approximately 8 cm and approximately 20 cm in the vertical direction 22 of the rucksack 10. The length of the adjustment range may be, for example, between approximately 10 cm and approximately 16 cm. The length of the adjustment range, or respectively a distance between the tick marks 114, to which here the symbol 116 in the form of the letter L on the one hand and the symbol 116 in the form of the letter S are arranged on the other hand, may amount to approximately 12 cm.

Through a respective placement of the coupling element to couple the two free ends 38, 40 with each other, for example in the form of the U-shaped hook 42 (cf. FIG. 2) it is possible to ensure that such a coupling element cannot be seen either in the highest position of the middle piece 16 or the lowest position of the middle piece 16, because in the respective positions, the coupling element can be covered by a pad 118 of the rucksack 10 (cf. FIG. 1), for example in the region of the kidneys, or, respectively, by the middle piece 16.

What is claimed is:

1. A rucksack comprising a first buckle element, a back part, a first shoulder strap and a second shoulder strap, each of the first and second shoulder straps including an end section, whereby the respective end sections of the shoulder straps are connected with each other by a middle piece, whereby the middle piece is continuously slidable along at least one guide element in a vertical direction of the rucksack, wherein the middle piece is attached to a strap, the strap including a first free end, a second free end, a first layer, and a second layer, whereby the free ends are coupled with each other in a way that permits a transfer of a tensile force, and whereby the first and second layers are movable in opposite directions by redirecting the strap around a first redirecting element and a second redirecting element, the first and second redirecting elements located opposite each other in a vertical direction of the rucksack, wherein one of the redirecting elements is formed on the first buckle element, and an arresting device comprising a lever arranged on the first buckle element, the lever including a lock position and a release position for a reversible attachment of the first layer relative to the second layer, wherein when the lever is in the lock position, the two layers are fastened relative to each other, and when the lever is in the release position, the two layers are movable in opposite directions, and a plate-like cover disposed against the lever, wherein at least part of the first buckle element is biased against the back part.

2. The rucksack according to claim 1, wherein the first buckle element is held to a first belt buckle part by a webbing, said first belt buckle part being detachably coupled with a second belt buckle part, whereby the second belt buckle part is fastened to a back part of the rucksack.

3. The rucksack according to claim 1, wherein the lever comprises a plurality of teeth formed to hook into the first layer and to prevent an upward movement of the middle piece in the vertical direction of the rucksack when the arresting device is in the lock position.

4. The rucksack according to claim 1, wherein the lever is configured to move from the lock position to the release position against the force of a spring element.

5. The rucksack according to claim 1, further comprising at least one mesh element attached to the middle piece to define a tunnel through which the first layer is disposed, whereby the first layer is connected with the at least one mesh element and whereby the second layer is disposed outside the tunnel.

6. The rucksack according to claim 1, wherein the free ends of the strap are connected by a second buckle element or are formed as loops, which are connected with each other by a belt buckle or a U-shaped hook including a first side and a second side, whereby each side of the hook is disposed through the loops.

7. The rucksack according to claim 6, wherein the sides of the hook are secured against coming off the loops by a fastening element.

8. The rucksack according to claim 1, wherein one of the redirecting elements is a ring hidden by a cover element, and is arranged in an upper region of a back part of the rucksack.

9. The rucksack according to claim 8, wherein the ring is constructed of a metal and/or a plastic.

10. The rucksack according to claim 1, wherein the at least one guide element includes first and second guide elements, and wherein when the first and second guide elements are in a first region in which the middle piece is continuously movable, the first and second guide elements have a first constant distance from each other, and when the first and second guide elements are in a second region, the first and second guide elements have a second distance from each other of less than the first constant distance.

11. The rucksack according to claim 8, wherein the ring is substantially rectangular.

12. The rucksack according to claim 10, wherein the second region is a region of a hip belt.

13. A rucksack, comprising:

a strap having a first free end and a second free end, wherein the free ends are coupled with each other in a way that permits a transfer of a tensile force;

a U-shaped hook connecting the free ends of the strap as loops, the hook including a first side and a second side, each of the sides disposed through the loops;

a fastening element securing the sides of the hook with the loops against coming off;

a middle piece attached to the strap and continuously slidable along at least one guide element in a vertical direction of the rucksack;

a first shoulder strap including an end section;

a second shoulder strap including an end section, wherein the respective end sections of the shoulder straps are connected with each other by the middle piece;

a first redirecting element; and a second redirecting element located opposite the first redirecting element in a vertical direction of the rucksack, wherein the strap is redirected at the first and second redirecting elements.

14. The rucksack according to claim 13, wherein the strap comprises a first layer and a second layer, the first and second layers movable in opposite directions by redirecting the strap around the redirecting elements, whereby an arresting device is provided for a reversible attachment of the first layer relative to the second layer.

15. The rucksack according to claim 14, wherein the arresting device comprises a lever including a lock position and a release position, wherein when the lever is in the lock position, the two layers are fastened relative to each other, and when the lever is in the release position, the two layers are movable in opposite directions.

16. The rucksack according to claim 15, further comprising a buckle element, wherein the lever is arranged on the buckle element, and wherein one of the redirecting elements is formed on the buckle element.

17. The rucksack according to claim 16, further comprising a back part and a plate-like cover disposed against the lever, wherein at least part of the buckle element is biased against the back part.

18. The rucksack according to claim 15, wherein the lever comprises a plurality of teeth formed to hook into the first layer and to prevent an upward movement of the middle piece in the vertical direction of the rucksack when the arresting device is in the lock position.

19. The rucksack according to claim 15, wherein the lever is configured to move from the lock position to the release position against the force of a spring element.

20. The rucksack according to claim 13, wherein the at least one guide element includes first and second guide elements, and wherein when the first and second guide elements are in a first region in which the middle piece is continuously movable, the first and second guide elements have a first constant distance from each other, and when the first and second guide elements are in a second region, the first and second guide elements have a second distance from each other of less than the first constant distance.

* * * * *